US010053948B2

(12) United States Patent
Hanson

(10) Patent No.: US 10,053,948 B2
(45) Date of Patent: Aug. 21, 2018

(54) TENSION-SET TIEBACK PACKER

(71) Applicant: Weatherford Technology Holdings, LLC, Houston, TX (US)

(72) Inventor: Andrew J. Hanson, Edmonton (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/282,896

(22) Filed: Sep. 30, 2016

(65) Prior Publication Data

US 2018/0094501 A1 Apr. 5, 2018

(51) Int. Cl.

| | |
|---|---|
| ***E21B 33/12*** | (2006.01) |
| ***E21B 33/129*** | (2006.01) |
| ***E21B 23/06*** | (2006.01) |
| ***E21B 33/128*** | (2006.01) |
| ***E21B 17/05*** | (2006.01) |
| *E21B 43/14* | (2006.01) |

(52) U.S. Cl.
CPC ..... *E21B 33/1292* (2013.01); *E21B 17/05* (2013.01); *E21B 23/06* (2013.01); *E21B 33/128* (2013.01); *E21B 43/14* (2013.01)

(58) Field of Classification Search
CPC ..... E21B 33/1292; E21B 23/06; E21B 23/01; E21B 43/10; E21B 33/12; E21B 33/129
See application file for complete search history.

(56) References Cited

U.S. PATENT DOCUMENTS

| | | | | |
|---|---|---|---|---|
| 3,991,826 | A * | 11/1976 | Baugh | E21B 23/06 166/120 |
| 5,586,601 | A * | 12/1996 | Pringle | E21B 33/1295 166/120 |
| 7,114,573 | B2 | 10/2006 | Hirth et al. | |
| 8,561,709 | B2 | 10/2013 | Arce et al. | |
| 2004/0216877 | A1 | 11/2004 | Pedersen et al. | |

(Continued)

FOREIGN PATENT DOCUMENTS

GB 2218442 A 11/1989

OTHER PUBLICATIONS

D&L Oil Tools, "DL Tension & DL Shear Tension Packer," Product Brochure, revision dated Oct. 2014.

(Continued)

*Primary Examiner* — Zakiya W Bates
(74) *Attorney, Agent, or Firm* — Blank Rome LLP

(57) ABSTRACT

An apparatus for supporting tubing in casing includes a setting tool and a liner top packer, which can be used for tieback. A setting slip is disposed uphole of a packing assembly on the packer and is movable from a retracted to an extended state engaging the casing. The setting tool has a temporary connection to the packer and has a pack-off that seals the tool in the packer but allows for movement. After running downhole, the temporary connection of the setting tool to the packer is disconnected, and the setting slip is set in the casing by moving the setting tool in an uphole direction. To set the packing assembly, the packer is moved in the uphole direction by engaging the setting tool with the pack-off and compressing the packing element (e.g., packing element and opposing cones and slips) against the set setting slip. Eventually, the setting tool is disconnected from the packer by disengaging the pack-off.

28 Claims, 9 Drawing Sheets

(56) References Cited

U.S. PATENT DOCUMENTS

2013/0048268 A1* 2/2013 Crow ..... E21B 31/16
166/55.7

OTHER PUBLICATIONS

D&L Oil Tools, "DL Tension Packer," Product Brochure, revision dated Oct. 2014.
Team Oil Tools, "Completion Tools Catalog," Product Catalog, copyright 2012.
Baker Hughes, "Reliant(TM) 10 Homet(TM) Mechanical Tension Set Packer," Technical Guide, dated May 31, 2012.
TIW Corporation, "L Liner Top Packer," Product Brochure, undated, obtained from http://www.tiwtools.com/linerhangarsystems/Liner-Packers on Mar. 25, 2015.
TIW Corporation, "LX Liner Top Packer," Product Brochure, undated, obtained from http://www.tiwtools.com/linerhangarsystems/Liner-Packers on Mar. 25, 2015.
TIW Corporation, "HLX Liner Top Packer," Product Brochure, undated, obtained from http://www.tiwtools.com/linerhangarsystems/Liner-Packers on Mar. 25, 2015.
Team Oil Tools, "32A Tension Set Packer," Product Brochure, copyright 2012.
Weatherford, "ArrowSet I-X Mechanical Production Packers," Product Brochure, copyright 2003.
Weatherford, "APC-1 Tandem Tension Packer," Product Brochure, copyright 2007.
Search and Examination Report in UK Appl. GB1715743.9, dated Feb. 1, 2018, 6-pgs.

* cited by examiner

TENSION-SET TIEBACK PACKER

CROSS-REFERENCE TO RELATED APPLICATIONS

This application is co-pending with U.S. application Ser. No. 14/693,076, filed 22 Apr. 2015 and entitled "Tension-Set Tieback Packer," which is incorporated herein by reference in its entirety.

BACKGROUND OF THE DISCLOSURE

A liner top packer is run as a part of a liner-hanger assembly to create a reliable liner-top seal between the host casing and the liner string. Additionally, the liner top packer can isolate formation pressures below the liner top from the casing above, can isolate treating pressures or acid work below the liner top from the casing, can isolate fluids while cement sets, can mitigate gas migration, and can isolate lost circulation zones. The liner top packer can also be used as a tieback completion or production packer. Therefore, the liner top packer serves a number of important and useful purposes.

In current techniques, hydraulics are used to set a liner top packer. For example, a liner top packer 30 as shown in FIG. 1A is hydraulically set in casing 10 with a hydraulic setting tool 20. The setting tool 20 has a bushing 22 disposed on a splined shaft 24 and threaded to a lock sub 31 of the packer 30. The setting tool 20 also includes hydraulic pistons 26 and a setting sleeve 28. The packer 30 includes a mandrel 32 coupled to the lock sub 31. Opposing slips 34 and cones 36 are disposed on the mandrel 32 on either side of a packing element 38.

During setting operations, the setting tool 20 is coupled by the bushing 22 to the lock sub 31 and the packer's mandrel 32 to run the packer 30 in the casing 10. When setting depth is reached, hydraulic pressure communicated in the setting tool 20 actuates the pistons 26, which pushes the setting sleeve 28 downward to compress the slips 34, the cones 36, and the packing element 38 and to set the packer 30. To build up pressure, a sub 23 threaded into the splined shaft 24 accepts a ball, which seals off the tubing to build pressure in the pistons 26. Rotation of the setting tool 20 then unthreads the bushing 22 from the lock sub 31 so the tool 20 can be retrieved.

As an alternative to the use of hydraulics, current techniques run and mechanically set a separate liner hanger below a liner top packer so a compression setting tool can then be used to set a liner top packer. For example, a liner top packer 30 as shown in FIG. 1B is coupled uphole of a separate liner hanger 35. The packer 30 has a packing element 38 disposed on the mandrel 32. The liner hanger 35 has slips 37*a* that are moved against cones 37*b* using a J-slot mechanism 39.

The packer 30 and liner hanger 35 are run in hole with the setting tool 20. When setting depth is reached, the liner hanger 35 is set in the casing 10 by operating the J-slot mechanism 39 and wedging the slips 37*a* with the cones 37*b* against the casing 10. At this point, rotation of the setting tool 20 unthreads the bushing 22 from the lock sub 31. The setting tool 20 is then lifted uphole inside the surrounding setting sleeve 28 until dogs 25 on the tool 20 bias outward beyond the distal end of the sleeve 28. Downhole movement of the setting tool 20 then engages the dogs 25 against the sleeve 28 so the sleeve 28 can be pushed against the packing element 38 on the packer 30 to set it against the casing 10. The setting tool 20 can then be removed.

Although these current techniques are successful, they may not be suitable for some implementations. For instance, using hydraulics downhole may be undesirable in implementations that have equipment that is pressure activated. Also, using a separate liner hanger adds additional cost to the assembly, which may be undesirable. These and other reasons may make alternative techniques more favorable for setting a liner top packer.

The subject matter of the present disclosure is directed to overcoming, or at least reducing the effects of, one or more of the problems set forth above.

SUMMARY OF THE DISCLOSURE

According to the present disclosure, an apparatus for supporting tubing, such as a liner, in casing of a borehole includes a packer and a setting tool. The packer can be a liner top packer. The packer has a housing and a packing element. The housing defines a bore and is coupled to the tubing extending downhole therefrom. The packing element is disposed on the housing and is settable from an unpacked state to a packed state in the casing. For example, the packing element can include at least one packing slip, at least one packing cone, and at least one compressible element, which are disposed on the housing adjacent one another and are movable against one another to set in the casing.

The setting tool for setting the packer is retrievable after setting. The setting tool has an inner mandrel and an outer mandrel. The outer mandrel has at least one setting slip being movable from a retracted state away from the casing to an extended state toward the casing. Additionally, the outer mandrel has a first rotatable connection to the inner mandrel and initially holds the at least one setting slip in the retracted state. For its part, the inner mandrel has a second rotatable connection to the housing of the packer.

The inner mandrel rotated with first rotation relative to the outer mandrel releases the first rotatable connection (between the inner and outer mandrels). This permits extension of the at least one setting slip on the outer mandrel for setting in the extended state in the casing. The inner mandrel moved after the first rotation with first movement relative to the outer mandrel pulls the housing against a portion of the outer mandrel. This pulling compresses the packing element to the packed state in the casing.

The inner mandrel rotated with second rotation relative to the outer mandrel then releases the second rotatable connection (of the inner mandrel) to the housing. This permits retrieval of the setting tool from the packer. For instance, the inner mandrel moved after the second rotation with second movement releases the at least one setting slip from the extended state toward the retracted state.

The first and second rotations discussed above can be in opposite directions. Although less desirable, it is possible to have the first and second rotations be made in the same direction. In this case, a first number of turns for the first rotation to release can be less than the second number of turns in the same direction for the second rotation. The first rotatable connection can include bayonets engaged between the outer mandrel and the inner mandrel. Alternatively, the first rotatable connection can use a course thread. The second rotatable connection can include a nut disposed on a splined shaft of the inner mandrel and threaded to an internal thread in the bore of the housing.

Between the first and second rotatable connections, the setting tool can have a swivel. With the first rotation of the inner mandrel (to release the first rotatable connection), the swivel clutches so that the first rotation is not transferred to the second rotatable connection of the inner mandrel to the packer. However, with the second rotation of the inner mandrel (to release the second rotatable connection), the swivel transfers this second rotation to the second rotatable connection.

The setting tool can have a first shearable connection temporarily holding the outer mandrel to the inner mandrel. The outer mandrel can include a sleeve disposed external to the housing and having a portion (i.e., shoulder, end, or edge) engaging adjacent the packing element. The outer mandrel can also include a cage holding the at least one setting slip and having upper and lower opposing cones for engaging the at least one setting slip.

The sleeve extends from the cage and is coupled to the lower opposing cone with a second shearable connection. During setting described above, the inner mandrel rotated with the first rotation releases the cage from the inner mandrel and permits the upper opposing cone to move toward the lower opposing cone and wedge the at least one slip outward toward the casing. A portion, such as a shoulder of the inner mandrel moved with the second movement, engages the upper opposing cone and releases the at least one setting slip. For setting and retrieving, various shoulders can engage one another on the components of the cage, the cones, the sleeve, the inner mandrel, etc.

According to the present disclosure, a tool can set a packer to support tubing in casing of a borehole. The packer has a housing and a packing element. The tool can include elements as discussed above with respect to the setting tool.

A method according to the present disclosure can support tubing or liner in casing of a borehole. The tubing is run in the casing with a setting tool coupled to a packer on the tubing. A setting slip of an outer mandrel of the setting tool is released by rotating an inner mandrel of the setting tool with a first rotation relative to the outer mandrel. The setting slip is set in the casing by moving the inner mandrel in a first direction relative to the outer mandrel. A packing element on the packer is set in the casing by moving the inner mandrel in a second, opposite direction relative to the outer mandrel and by pulling the packing element against the outer mandrel held in the casing by the set setting slip. The inner mandrel of the setting tool is finally released from the packer by rotating the inner mandrel with a second, opposite rotation relative to the outer mandrel.

To release the inner mandrel of the setting tool from the packer, the setting slip is released from the casing by moving the inner mandrel relative to the outer mandrel in the second direction after the second rotation. Releasing the setting slip of the setting tool can involve rotating the inner mandrel of the setting tool with the first rotation relative to the outer mandrel by unthreading a first rotatable connection of the inner mandrel to the outer mandrel.

To release the inner mandrel of the setting tool from the packer, a second rotatable connection of the inner mandrel to the packer can be unthreaded. In this case, rotating the inner mandrel of the setting tool with the first and second rotations can involve clutching the first rotation of the inner mandrel with a swivel relative to the second rotatable connection and transferring the second rotation of the inner mandrel with the swivel to the second rotatable connection.

To set the packing element on the packer in the casing, the packing element is compressed against the casing by moving at least one slip, at least one cone, and a compressible element disposed on the packer against one another with the movement against the set outer mandrel. The method can further involve cementing the tubing in the borehole by conducting the cement through the setting tool before it is retrieved.

In the disclosed embodiments, setting the packer does not require hydraulics, and the assembly does not require a separate liner hanger. Using the frictional factors between the tools and the casing (as well as biting of slips into the casing) allows setting the compression set packer with an upstroke.

The packer as disclosed herein can be a liner top packer run as a part of a liner hanger assembly. The liner top packer can create a liner-top seal between host casing and a liner string, can isolate formation pressures below the liner top from the casing above, can isolate treating pressures or acid work below the liner top from the casing, can isolate fluids while cement sets, can mitigate gas migration, can isolate lost circulation zones, etc. The disclosed packer can also be used as a tieback completion or production packer.

The foregoing summary is not intended to summarize each potential embodiment or every aspect of the present disclosure.

BRIEF DESCRIPTION OF THE DRAWINGS

FIG. 2A illustrates an assembly according to the present disclosure having a liner top packer and a setting tool during run in.

FIG. 5 illustrates another assembly according to the present disclosure having a liner top packer and a setting tool during run in.

DETAILED DESCRIPTION OF THE DISCLOSURE

Figure 1A:
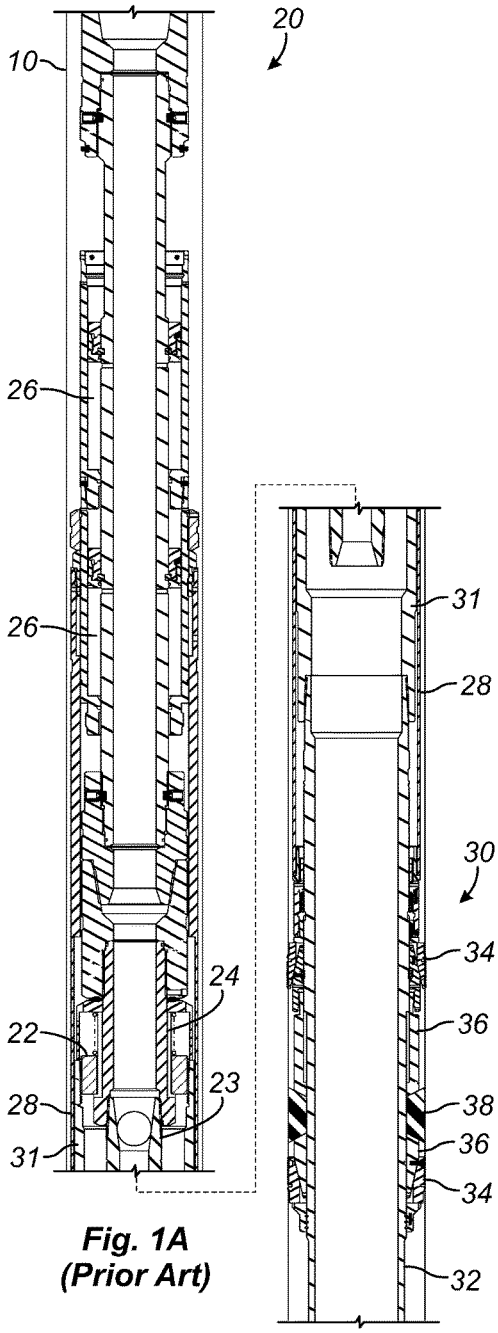
Fig. 1A (Prior Art)
FIG. 1A illustrates a prior art technique for setting a liner top packer using a hydraulic setting tool.
Figure 1B:
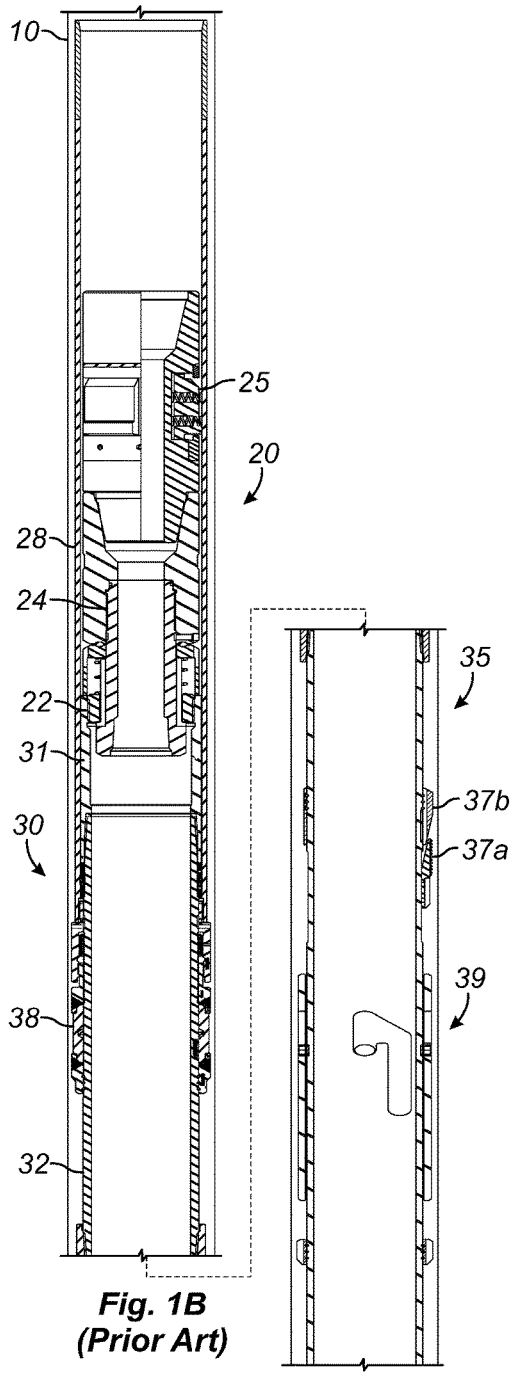
Fig. 1B (Prior Art)
FIG. 1B illustrates another prior art technique for setting a liner top packer using separate liner hanger and setting tool.
Figure 2A:
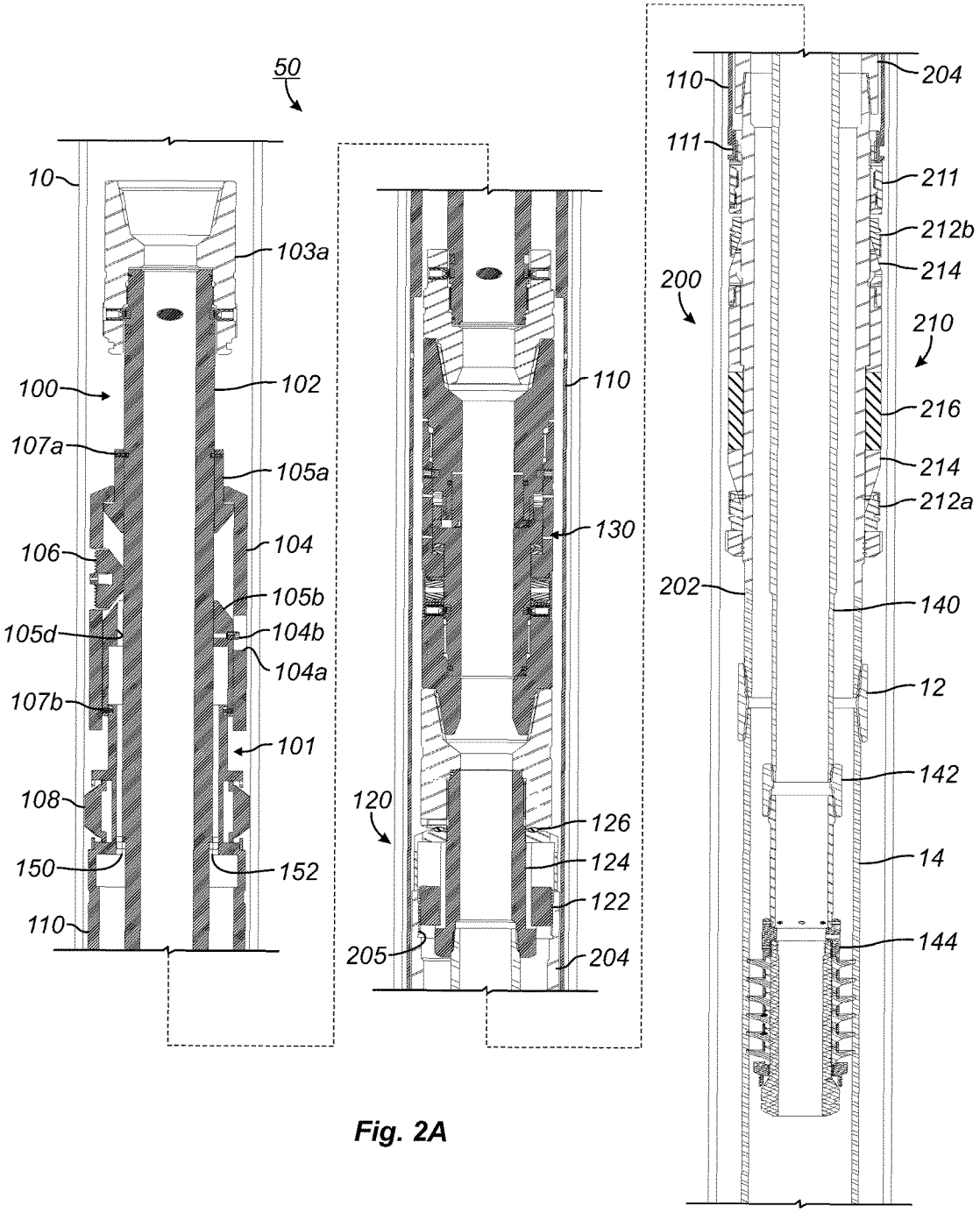
Figure 2B:
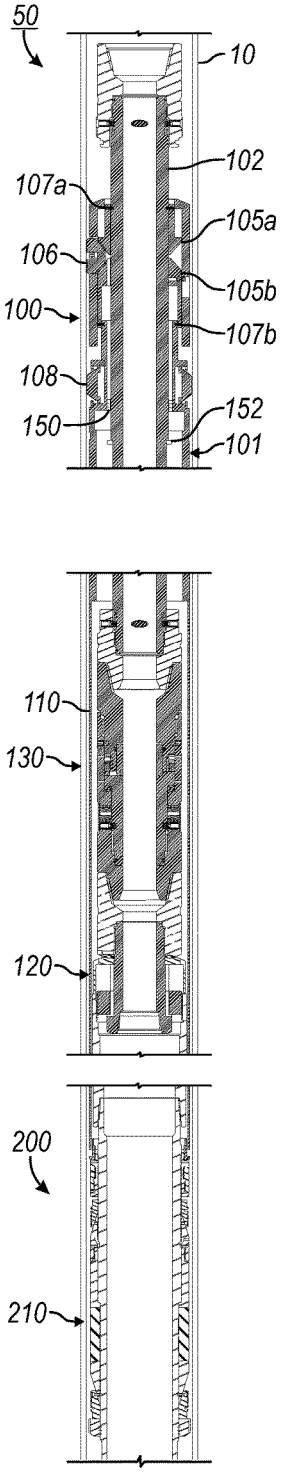
FIGS. 2B-2E illustrate the disclosed assembly during stages of setting the packer.
Figure 2C:
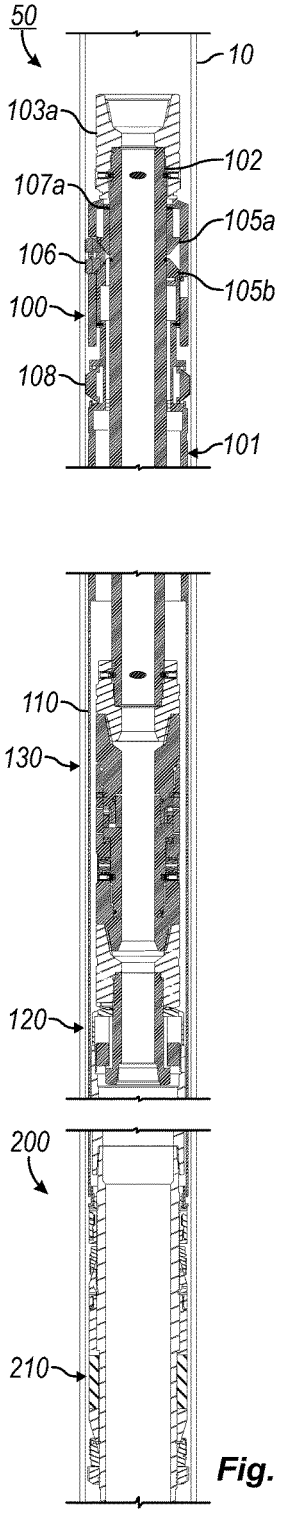
Figure 2D:
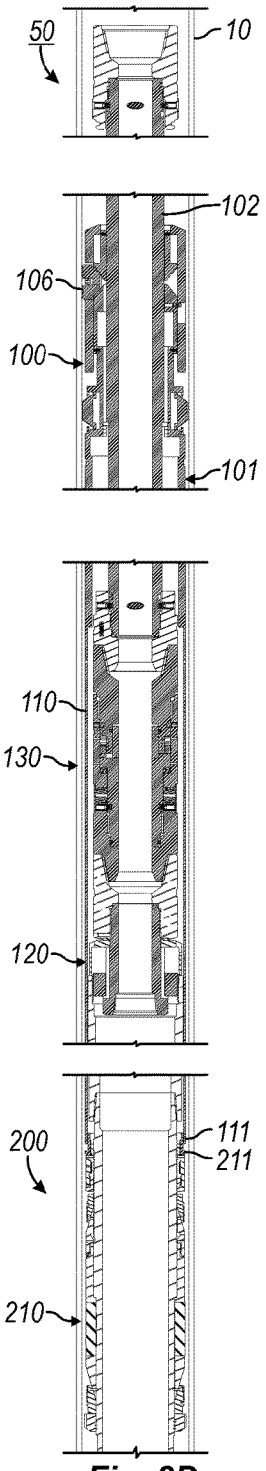
Figure 2E:
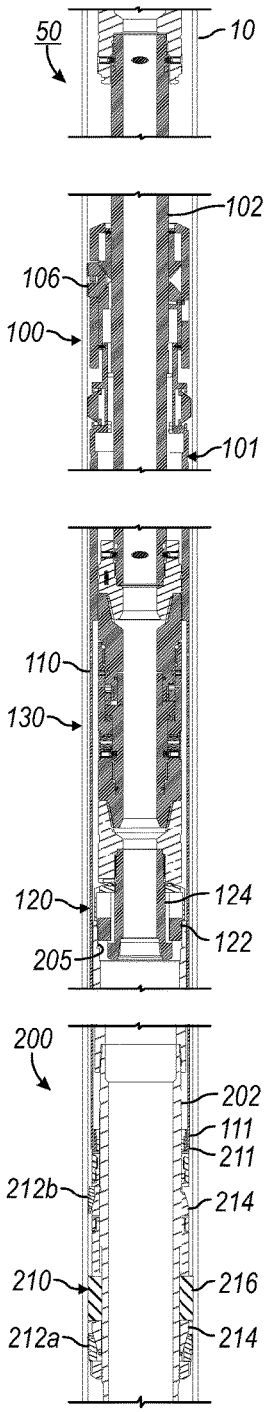
Figure 2F:
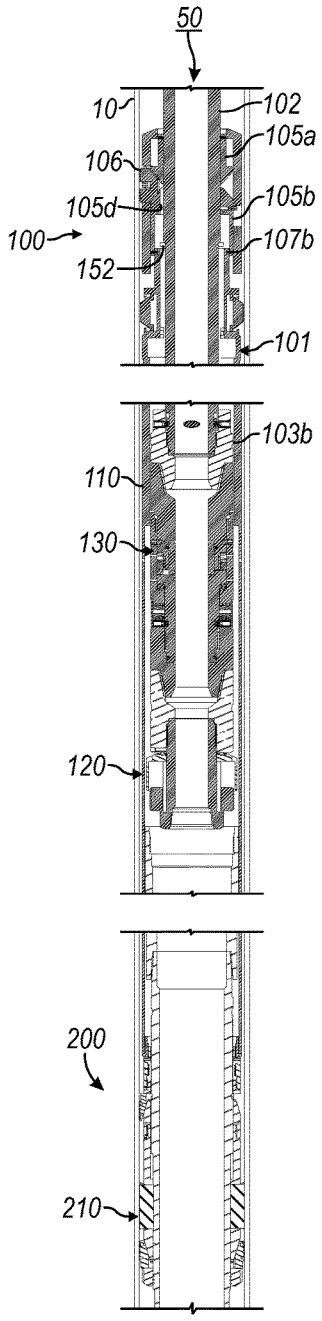
FIGS. 2F-2J illustrate the disclosed assembly during stages of removing the setting tool from the set packer.
Figure 2G:
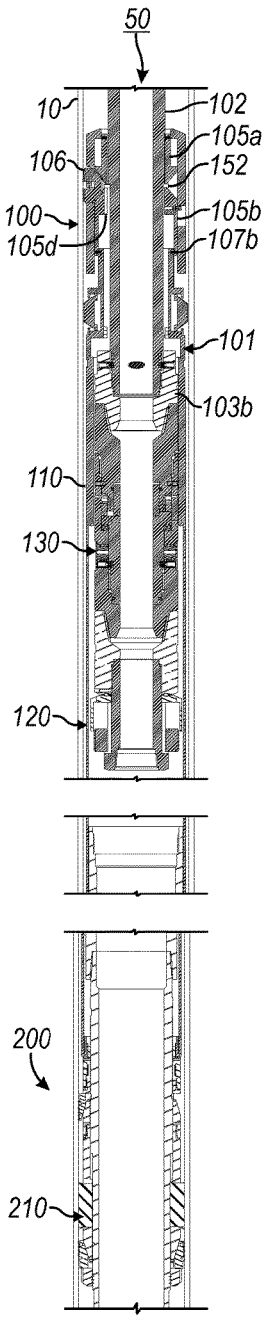
Figure 2H:
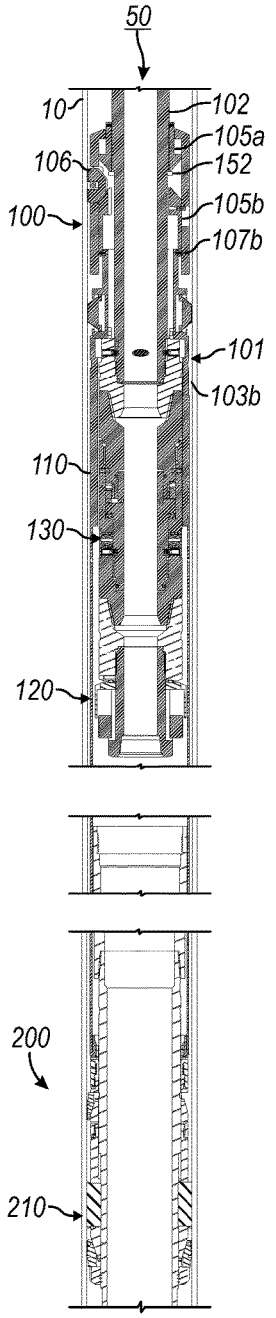
Figure 2I:
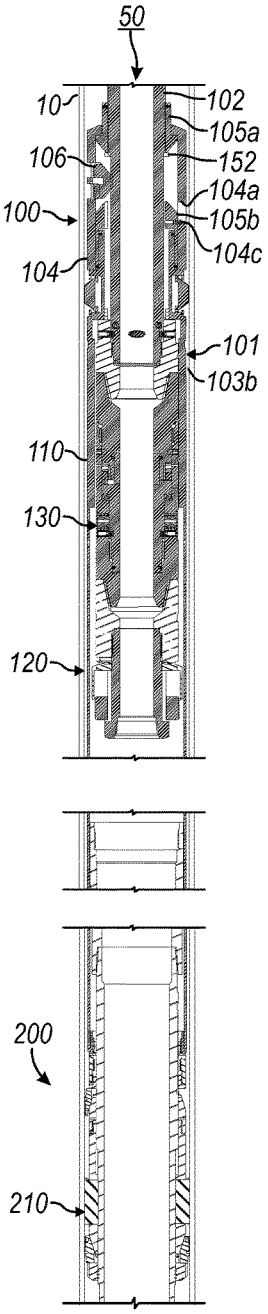
Figure 2J:
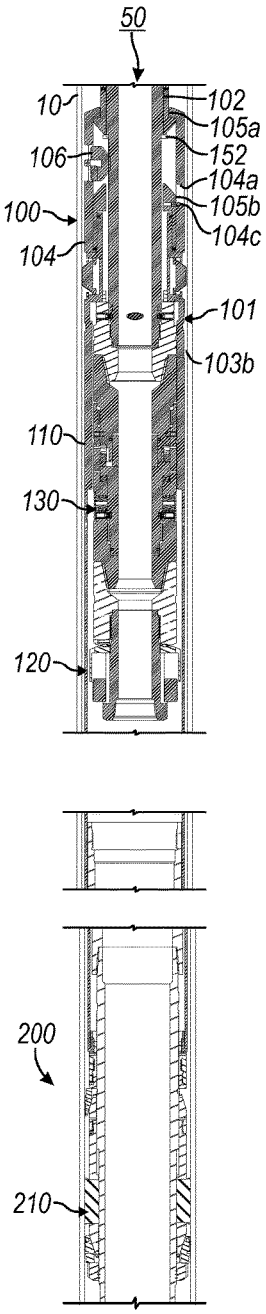

FIGS. 2A through 2J show cross-sectional views of an assembly 50 according to the present disclosure having a packer 200 and a setting tool 100. The assembly 50 is shown in a number of positions, such as running the assembly 50 in hole (FIG. 2A) to pulling the setting tool 100 out of hole (FIG. 2J). The packer 200 as disclosed herein can be a liner top packer run as a part of a liner hanger assembly. Additionally, the disclosed packer 200 can also be used as a tieback packer by allowing the liner to be extended to the surface or farther uphole in a tieback arrangement.

Looking first at FIG. 2A, the liner top packer 200 and the setting tool 100 are shown during run-in. The liner top packer 200 includes a housing 202. An uphole end of the housing 202 has an upper latch sub 204, and a downhole end is coupled to liner tubing 14 by a coupling 12.

The packer's housing 202 has a packing assembly 210 with opposing slips 212*a-b* that can ride up cones 214 on both sides of a packing element 216, such as a compressible elastomeric sleeve. In particular, the packing element 216 is compressible from an unpacked state to a packed state in the casing 10. When set, the hanging slips 212*a* set toward the downhole end of the packing element 216 to keep the housing 202 from moving downhole. Meanwhile, the hold-down slips 212*b* set toward the uphole end of the packing element 216 to keep the housing 202 from moving back uphole due to pressure from below.

Hydraulic setting mechanisms are not present on the setting tool 100 because the liner top packer 200 is set with tension, as will be described below. The setting tool 100 has an inner mandrel 102 with an upper coupling or sub 103*a* for attaching to a running string (not shown). The setting tool 100 also has an outer mandrel 101 including a cage 104 and a sleeve 110 disposed along the inner mandrel 102. A distal end of the inner mandrel 102 couples to a swivel 130, which is connected to a bushing assembly 120. Some components of the setting tool 100 can extend from the bushing assembly 120 and through the packer housing 202. As depicted in FIG. 2A, for example, an optional pup or pipe section 140 extends from the bushing assembly 120 through the packer 200 and connects by a coupling 142 to a removable wiper 144.

The cage 104 includes setting slips 106 and cones 105*a-b*. The cage 104 also includes drag blocks 108 that run inside the casing 10. For example, springs (not shown) between the drag blocks 108 and the outer mandrel 101 may force the drag blocks 108 outwards in windows (not labeled), which drives the drag blocks 108 against the casing 10. This provides friction to allow for rotation of the inner mandrel 102 relative to the cage 104. The setting slips 106 are initially held against the tool's inner mandrel 102 so as not to engage the surrounding casing 10 during run in. The cones 105*a-b* are initially held apart so as to not push the setting slips 106 outward from the cage 104. In particular, an upper shearable connection 107*a* holds the upper cone 105*a* to the inner mandrel 102, and a lower shearable connection 107*b* holds the lower cone 105*b* to the sleeve 110 of the tool's outer mandrel 101. When released, however, the lower cone 105*b* can only move between limits relative to the cage 104 by one or more pins 104*b* movable in a window 104*a* of the cage 104. The lower cone 105*b* has a slot 105*d* for eventual passage of the bayonet profile, or pins, as described later.

The outer sleeve 110 extends from the cage 104 of the setting tool 100 over the packer's latch sub 204. A distal end 111 of the sleeve 110 on the setting tool 100 engages a push ring 211 uphole of the packing assembly 210.

A first rotatable connection 150 exists between the outer mandrel 101 and the inner mandrel 102 for temporarily holding them together so that the setting slips 106 remain retracted. Briefly, the connection 150 includes mating bayonets engaged between the inner mandrel 102 and the outer mandrel 101 (i.e., cage 104 and/or sleeve 110). During run in, the engaged bayonets of the connection 150 hold the mandrels 101, 102 in place, but a partial turn (i.e., ⅙ of a turn) in one direction will release the outer mandrel 101 from the inner mandrel 102 so the setting slips 106 can be set. Further details are discussed below. As an alternative to bayonets, however, the connection 150 may instead use course threads or J-slot mechanism.

The swivel 130 transfers rotation/torque of the mandrel 102 turned in one direction (i.e., to the right) to the bushing assembly 120. However, the swivel 130 clutches when the mandrel 102 is turned in an opposite direction (i.e., to the left) so that rotation/torque is not transferred to the bushing assembly 120, which acts as a second rotatable connection. The swivel 130 can transfer torsion in axial compression, tension, or no load between the mandrel 102 and the bushing assembly 120. Although the swivel 130 can operate in any of compression, tension or neutral, the disclosed assembly 50 can still operate if the swivel 130 were only configured to transfer torque in one or more of those axial conditions; that condition would just have to be obtained during operations. For example, the swivel 130 that only transfers torque in compression would require the string to be in compression to transfer torque. Lastly, although preferred, use of a swivel 130 as disclosed is optional because the assembly 50 can operate without a swivel.

The bushing assembly 120 extending from the swivel 130 couples to the packer 200. In particular, the bushing assembly 120 has a nut or bushing 122 disposed on a splined shaft 124. The splined shaft 124 couples at an uphole end to the tool's inner mandrel 102. It may also couple at its downhole end to the pipe section 140 if desired. Rotation of the tool's mandrel 102 transferred through the swivel 130 thereby rotates the splined shaft 124 and the pipe section 140 if present. Rotation of the splined shaft 124 rotates the nut 122 thereon relative to internal thread 205 in the latch sub 204. Bearings 126 disengage the rotation so that rotating the running tool 100 to turn the nut 122 in the internal threads 205 of the latch sub 204 does not rotate the packer 200.

With an understanding of the components of the assembly 50, discussion now turns to its operation. Briefly, the setting tool 100 once run in hole is operated to release the outer mandrel 101 at the first rotatable connection 150 with rotation of the inner mandrel 102 and to set the setting slips 106 on the outer mandrel 101 against the casing 10 (FIGS. 2A-2C). Cementing can be performed if desired. Then, the packer 200 is set by pulling up against the fixed setting sleeve 110 to set the packer's element 210 (FIGS. 2D-2E). After setting the packer 200, the setting tool 100 is then released from the packer 200 at the second rotatable connection 120 with opposite rotation to that used to release the first connection 150 (FIG. 2F). The setting tool 100 is then retrieved in tension (FIGS. 2G-2J) from the set packer 200.

Overall, the setting procedures do not require hydraulics for actuation, and there is no requirement for a separate liner hanger. The retrievable setting sleeve 110 and setting tool 100 allow the packer 200 to be the set with tension, which is advantageous in setting a liner and the like in casing 10, for example, in shallow or deviated wells or if rig capacity in compression is limited.

Looking at the setting procedures in more detail, FIG. 2A shows the assembly 50 during run-in. The setting slips 106 are held retracted from the casing 10 using spring rings (not shown) or the like, and the packing assembly 210 (e.g., 212*a-b*, 214, 216) on the packer 200 is uncompressed away from the casing 10 in which the packer 200 is run. The bushing assembly 120 on the setting tool 100 engages the latch sub 204 of the housing 202 so that the setting tool 100 can run the packer 200 through the casing 10. Meanwhile, as depicted in FIG. 2A, the setting tool's optional pipe section 140 extends inside the packer 200. (For simplicity, the optional pipe section 140 and some other components depicted in FIG. 2A are not shown in FIGS. 2B-2J.)

Once the setting tool 100 runs the packer 200 to the desired depth in the casing 10, setting procedures begin. As first shown in FIG. 2B, the inner mandrel 102 is rotated with a first rotation, which can be to the left a partial turn (e.g., ⅙ of a turn), to release the first rotatable connection 150 between the inner mandrel 102 and the outer mandrel 101. As noted above, this release involves the first rotatable connection 150 having mating bayonets.

Figure 3A:
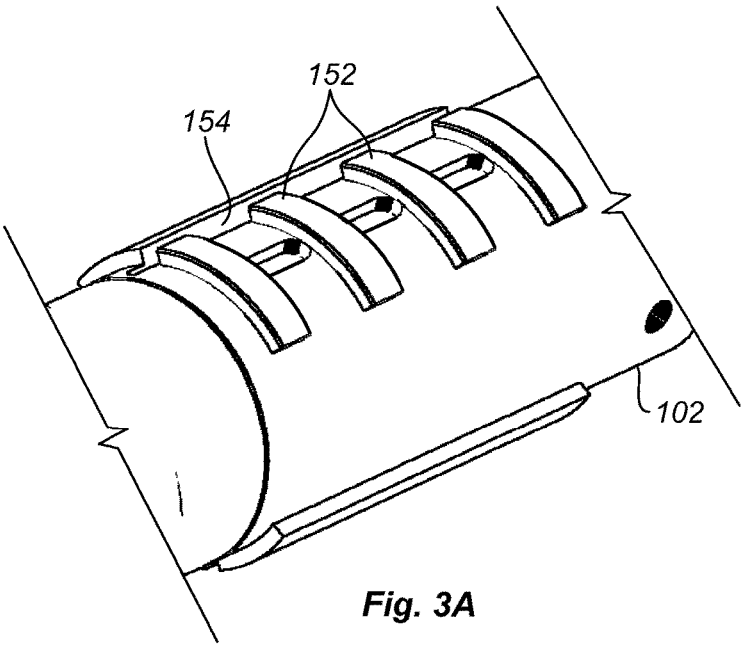
FIGS. 3A-3B illustrate details of a first rotatable connection for the setting tool.
Figure 3B:
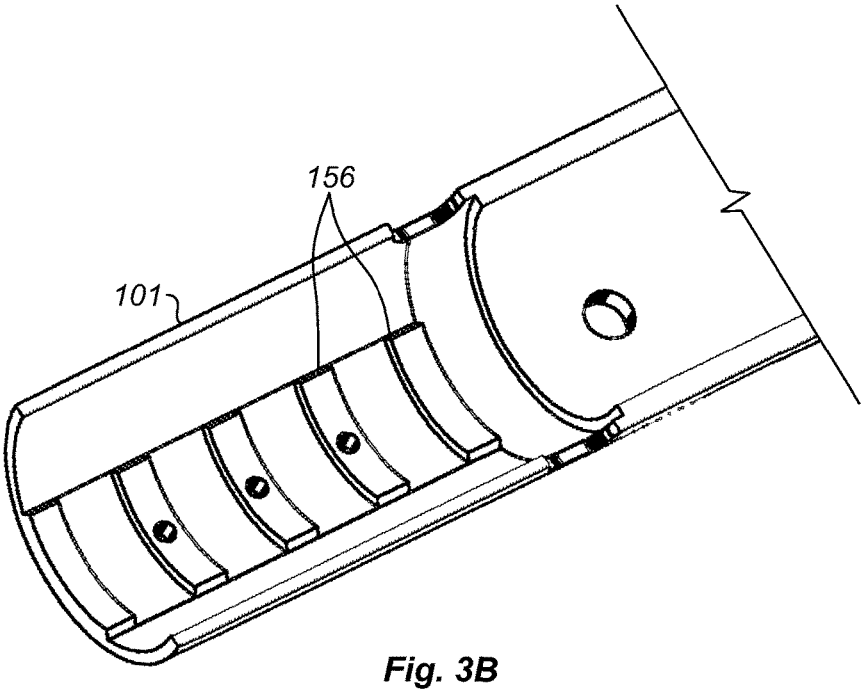

As shown in FIG. 3A, for example, a portion of the inner mandrel 102 is shown in an isolated, perspective view and includes external bayonets 152 and a drive face 154. Meanwhile in FIG. 3B, a portion of the outer mandrel 101 (i.e., cage 104 and/or sleeve 110) is shown in isolated, cross-section and includes internal bayonets 156 for mating with the external bayonets 152. In an initial position, the female and male components 101 and 102 mate together with the external and internal bayonets 152, 156 engaging one another. This allows for pushing or pulling both components 101 and 102 together as one during run in. With right hand rotation of the inner mandrel 102, the drive face 154 pushes on the edges of the internal bayonets 156 so the components 101 and 102 rotate together. By contrast, with left hand rotation of the inner mandrel 102, the drive face 154 separates from the internal bayonets 156. Once separated, the female and male components 101 and 102 are no longer supported and pushing or pulling the male component (i.e., inner mandrel 102) does not move the female component (i.e., outer mandrel 101).

Figure 3C:
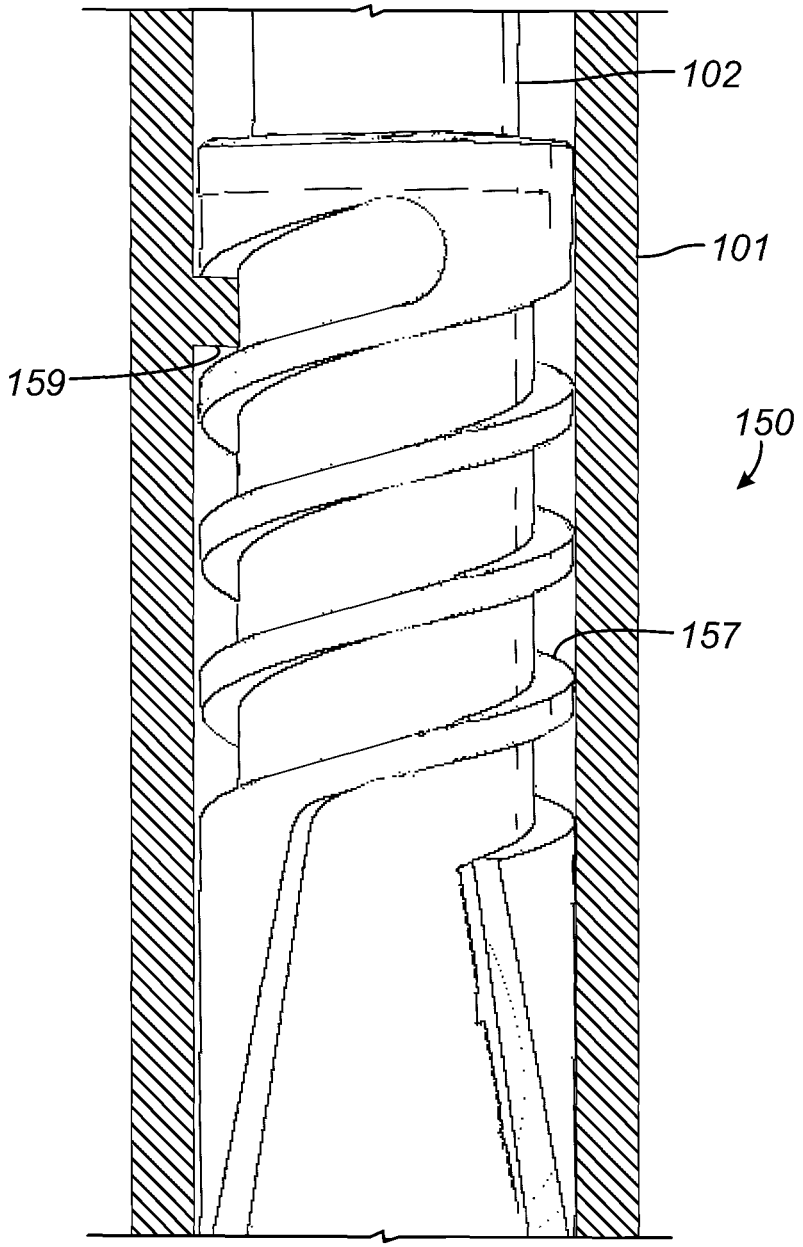
FIG. 3C illustrates details of another first rotatable connection for the setting tool.
Figure 4:
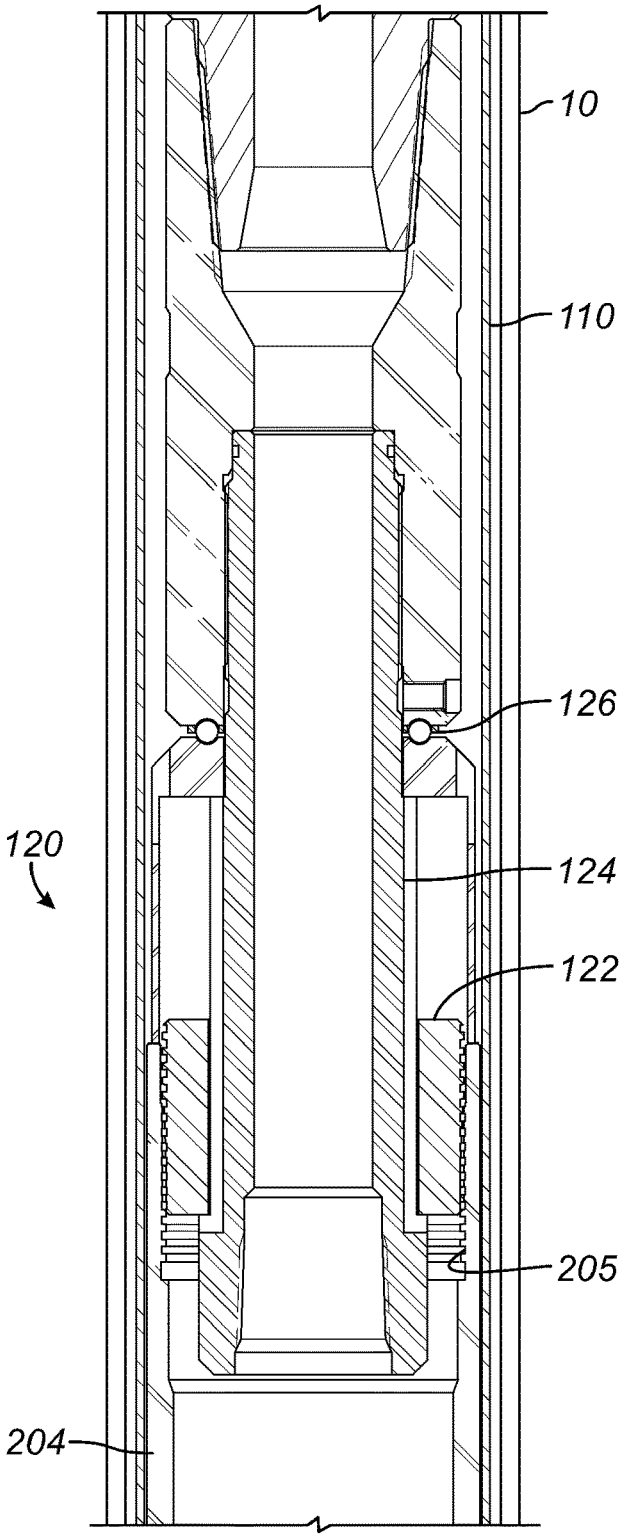
FIG. 4 illustrates a detail of a second rotatable connection for the setting tool.

As noted above, the first rotatable connection 150 may instead use course threads or J-slot mechanism. For example, FIG. 3C shows a portion of the inner mandrel 102 including a course male thread 157. Female threads 159 on the outer mandrel 101 can include one or more pins arranged about the inside of the outer mandrel 101 that can ride in the course male thread 157 on the inner mandrel 102.

Returning to FIG. 2B, once the first rotatable connection 150 is released, compression applied against the inner mandrel 102 then begins to set the tool 100. The drag blocks 108 on the cage 104 biased out to the casing 10 impede the movement of the cage 104, while the inner mandrel 102 can be pushed further against the cage 104. Eventually, the inner mandrel 102 pushes the upper cone 105*a* toward the lower cone 105*b* so that the setting slips 106 extend outward to the casing 10. As noted above, the upper cone 105*a* is secured to the mandrel 102 by the shearable connection 107*a*, and the lower cone 105*b* is secured to the outer mandrel of cage 104 and sleeve 110 by the other shearable connection 107*b*.

As shown in FIG. 2C, the setting slips 106 set against the casing 10. More compression on the setting tool 100 eventually shears out the upper cone 105*a* from the mandrel 102 by breaking the upper shearable connection 107*a*. The top sub 103*a* can then tag on the slip cage 104.

At this point, cementing operations can be performed using techniques know to those skilled in the art. In one method of this cementing operation, for example, the cement (not shown) precedes a cementing plug (not shown) and can pass down through the running string (not shown) and setting tool's pipe section (140: FIG. 2A). The cementing plug (not shown) engages the wiper (144: FIG. 2A), pushing it off the end of the pipe section (140: FIG. 2A), as the cement ahead of it continues down and out the liner tubing (14) into and up the annulus between said liner tubing and the casing 10.

When cementing is completed, operators begin setting the liner top packer 200. As shown in FIG. 2D, pulling up on the setting tool 100 begins to set the packer 200. The inner mandrel 102 can be pulled up while the cage 104 and sleeve 110 are held in the casing 10 by the set slips 106. The distal end 111 of the sleeve 110 contacts a push ring 211 for the packing element 210 on the packer 200 as the setting tool 100 lifts the packer 200 uphole.

As shown in FIG. 2E, further pulling up then completes the setting of the packer 200. In particular, further pulling uphole of the setting tool 100 moves the inner mandrel 102, the bushing 120, the latch sub 204, and the packer 200 with it, while the setting sleeve 110 remains fixed in the casing 10. The cones 214 wedge against the packing slips 212*a-b*. The pulling force further engages the slips 212*a-b* against the casing 10, and the cones 214 move along the packer housing 202 and force against the slips 212*a-b* and packing element 216 of the packer 200. To prevent reverse movement of the upper cone 214, a body lock ring and/or other comparable components can be used.

Eventually, the packing element 216 is compressed outward toward the casing 10, and the packing slips 212*a-b* are expanded outward against the cones 214 to bite inside the casing 10. The required tensile load can be applied and held for a suitable period of time to allow proper elastomer setting of the packer element 216.

With the packer 200 set, retrieval of the setting tool 100 then follows. As shown in FIG. 2F, second rotation, such as right hand rotation, of the inner mandrel 102 releases the second rotatable connection (i.e., the bushing assembly 120). In particular, this second rotation of the inner mandrel 102 is transferred to the bushing assembly 120 via the swivel 130 and unthreads the running nut 122 from the internal thread 205 of the housing's latch sub 204. This second rotation is typically in compression to make use of the bearing balls 126. Any suitable number of turns (e.g., approximately 11 turns) can be required. The nut 122 has a left-hand thread and is splined to the shaft 124 of the running tool 100 so the right hand rotation unthreads it from the latch sub 204. As noted, this second rotation can be opposite to the first rotation. Although less desirable, it is possible to have the first and second rotations be made in the same direction. In this case, a first number of turns for the first rotation to release can be less than the second number of turns for the second rotation.

Once the nut 122 is unthreaded from the latch sub 204, the running string (not shown) and the mandrel 102 are now moved uphole. With the uphole travel, the cage 104 and the setting sleeve 110 remain set. The uppermost male bayonet 152 on the inner mandrel 102, as shown in FIG. 2G, passes through the female bayonets and lower cone slot 105*d*, and eventually engages the upper setting cone 105*a* so that upward shifting of the inner mandrel 102 moves the upper cone 105*a* from supporting the setting slips 106. With the release of upper cone 105*a*, the bottom sub 103*b* tags against the drag cage 104, as shown in FIG. 2H. The lower cone 105*b* then shears out of the drag cage 104, as shown in FIG. 2I, by breaking the shear connection 107*b*. Finally, as shown in FIG. 2J, the inner mandrel 102 is stroked until the upper cone 105*a* picks up on the back of the drag cage 104. At this point, upward movement of the mandrel 102 then moves the cage 104 and disengages the slips 106.

The cage 104 ultimately shoulders out on the sleeve 110, and the setting tool 100 can be pulled out of hole. Although not depicted, the distal end 111 of the sleeve 110 can simply separate from the push ring 211 as the sleeve 110 is pulled further upward with the setting tool 100. Once the setting tool 100 has been removed, further operations can then be performed by running tubing to the upper sub 204 of the packer 200 to tie back the liner farther uphole or to the surface in a tieback arrangement.

Figure 5:
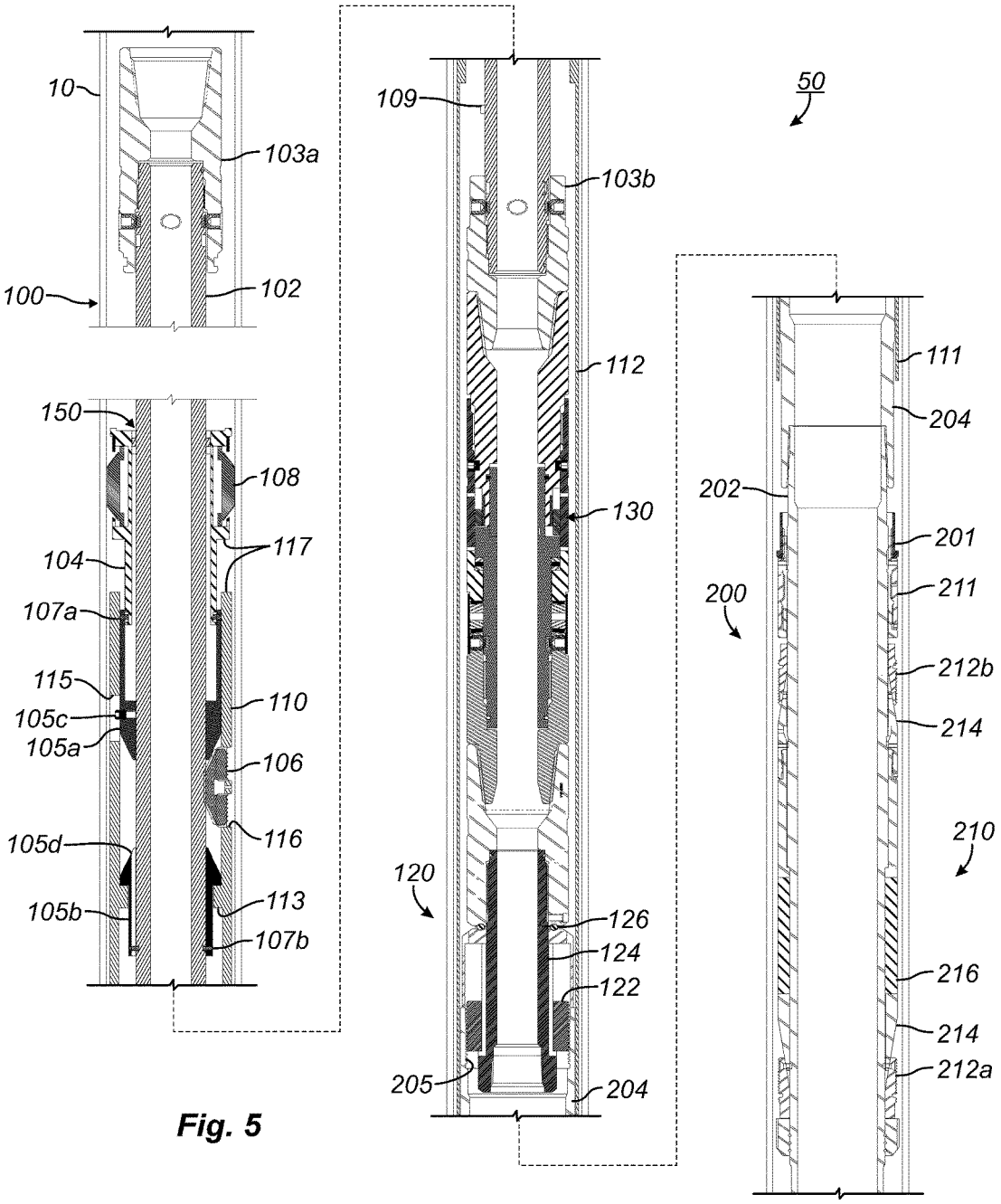

In the previous arrangement, the disclosed assembly 50 sets the anchor slips 106 with an initial movement in a downhole direction with resistance provided by the drag blocks 108 against the casing. As an alternative, another assembly 50 according to the present disclosure is illustrated in FIG. 5 having a liner top packer 200 and a setting tool 100 during run in. Components of this assembly 50 are similar to those disclosed previously so that like reference numerals are used for comparable components. Moreover, as will be appreciated, such comparable components may operate in the same way, which may not be specifically readdressed with reference to FIG. 5.

In this assembly 50, the drag cage 104 and drag blocks 108 are disposed uphole from the slip cage 110, anchoring slips 106, and cones 105*a-b*. In this way, the disclosed assembly 50 sets the anchor slips 106 with an initial movement in an uphole direction with the resistance provided by the drag blocks 108 against the casing 10.

In particular, the drag cage 104 holds the drag blocks 108, which are biased outward to the casing 10 by springs (not shown). The drag cage 104 is connected to the inner mandrel 102 by the first rotatable connection 150, which can include bayonets, course thread, or J-slot mechanism as noted herein. The drag cage 104 temporarily couples with shear screws 107*a* or the like to the upper cone 105*a* disposed in the space between the inner mandrel 102 and the slip cage 110 of the outer mandrel 101. The anchoring slips 106 are disposed in windows 116 of the slip cage 110 and are held against the inner mandrel 102 with slip springs (not shown).

At the opposing end of the slips 106, the slip cage 110 engages with a shoulder 113 against the lower cone 105*b*, which temporarily couples with shear screws 107*b* or the like to the inner mandrel 102. The lower cone 105*b* is spaced from a pin 109 on the inner mandrel 102, and the lower cone 105*b* includes a slot 105*d* for eventual passage of the pin 109, as described later.

Finally, the slip cage 110 includes a setting sleeve 112 that extends along the outside of the swivel 130, second rotatable connection 120, and tie back sub 204 toward the packer 200. During run-in as shown, the distal end of the setting sleeve 112 is distanced from an engagement ring/push ring 201 on the packer 200.

When the assembly 50 is run to the desired position in the casing 10, the inner mandrel 102 is turned (and optionally also pulled up) to release the first rotatable connection 150 of the bayonets, course thread, J-slot or the like. This releases the inner mandrel 102 from the drag cage 104 and slip cage 110. Pulling up on the inner mandrel 102 then sets the anchor slips 106 as the lower cone 105*b* connected to the inner mandrel 102 wedges against the slips 106 and the upper cone 105*a* is held by the drag blocks 108 encountering friction against the casing 10.

Additional tension on the inner mandrel 102 then shears the inner mandrel 102 from the lower cone 105*b* when the shear screws 107*b* shear. Lifting of the inner mandrel 102 then moves the packer 200 up to the setting sleeve 112. Additional tension on the inner mandrel 102 then shears and sets the packer 200. Once the packer 200 is set, the inner mandrel 102 is rotated to release the second rotatable connection 120, which can include the bushing nut, spline, and the like. Of course, other rotatable connections can be used.

Pulling up of the inner mandrel 102 then guides the pin 109 on the mandrel 102 past the lower cone 105*b* (i.e., under the slot 105*d*) so that the pin 109 tags against the upper cone 105*a*. Further pulling up causes the pin 109 to shear the upper cone 105*a* free of the drag cage 104, and the slot pins 105*c* on the upper cone 105*a* engage in the window 115 of the slip cage 110. Continued pulling up on the inner mandrel 102 causes the slip cage 110 to engage the drag cage 104 at shoulders 117. Then, the slip cage's shoulder 113 eventually re-contacts the lower cone 105*b* so that the setting tool 100 of the assembly 50 can be pulled out of hole while the packer 200 remains set in the casing 10.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

It is understood that any reference to right-hand rotation above may be replaced with left-hand rotation. However, right-hand rotation is generally preferred as this prevents unthreading of the conventional right-hand threaded tubulars. It is also understood that any mention of direction (e.g., uphole, downhole, up, down, etc.) is merely relative to facilitate explanation. In this regard, although the disclosed packer 200 and setting tool 100 have been disclosed with various components toward uphole and downhole ends and with operations in uphole and downhole directions, it will be appreciated that these orientations and directions can be reversed in a desired implementation.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An apparatus for supporting tubing in casing of a borehole, the apparatus comprising:

a packer having a housing and a packing element, the housing defining a bore and coupled to the tubing extending downhole therefrom, the packing element disposed on the housing and being settable from an unpacked state to a packed state in the casing; and a setting tool for setting the packer in the casing and being retrievable from the set packer, the setting tool having an inner mandrel and an outer mandrel, the outer mandrel having at least one setting slip being movable from a retracted state away from the casing to an extended state toward the casing, the outer mandrel having a first rotatable connection to the inner mandrel and permitting the at least one setting slip to be in the retracted state, the inner mandrel having a second rotatable connection to the housing of the packer, the inner mandrel rotated with first rotation relative to the outer mandrel releasing the first rotatable connection and permitting extension of the at least one setting slip for setting in the extended state in the casing, the inner mandrel moved after the first rotation with first movement relative to the outer mandrel pulling the housing against a portion of the outer mandrel and compressing the packing element to the packed state in the casing, the inner mandrel rotated with second rotation relative to the outer mandrel releasing the second rotatable connection to the housing.

2. The apparatus of claim 1, wherein the inner mandrel moved after the second rotation with second movement releases the at least one setting slip from the extended state toward the retracted state.

3. The apparatus of claim 2, wherein the first and second movements are both in an uphole direction.

4. The apparatus of claim 1, wherein the packing element comprises at least one packing slip, at least one packing cone, and at least one compressible element disposed on the housing adjacent one another and being movable against one another to set in the casing.

5. The apparatus of claim 1, wherein the first rotation of the inner mandrel is in an opposite direction to the second rotation of the inner mandrel.

6. The apparatus of claim 1, wherein the first rotatable connection comprises bayonets engaged between the outer mandrel and the inner mandrel.

7. The apparatus of claim 1, wherein the second rotatable connection comprises a nut disposed on a splined shaft of the inner mandrel and threaded to an internal thread in the bore of the housing.

8. The apparatus of claim 1, wherein the inner mandrel moved after the first rotation with initial movement relative to the outer mandrel before the first movement extends the at least one setting slip toward the extended state.

9. The apparatus of claim 8, wherein the first movement is in an uphole direction, and wherein the initial movement is in either the uphole direction or in a downhole direction.

10. The apparatus of claim 8, wherein the outer mandrel comprises at least one drag block biased outward to engage against the casing, whereby the initial movement of the inner mandrel resisted by the engagement of the at least one drag block against the casing extends the at least one setting slip toward the extended state.

11. The apparatus of claim 1, wherein the setting tool comprises a swivel disposed between the first and second rotatable connections, the swivel clutching with the first rotation of the inner mandrel and transferring the second rotation of the inner mandrel to the second rotatable connection.

12. The apparatus of claim 1, wherein the outer mandrel comprises a sleeve disposed external to the housing and having the portion engaging adjacent the packing element.

13. The apparatus of claim 1, wherein the outer mandrel comprises a cage holding the at least one setting slip and having upper and lower opposing cones for engaging the at least one setting slip.

14. The apparatus of claim 13, wherein the outer mandrel comprises a sleeve extending from the cage and coupled to the lower opposing cone, the sleeve having the portion for compressing against the packing assembly, the inner mandrel rotated with the first rotation releasing the cage from the inner mandrel and permitting the upper opposing cone to move toward the lower opposing cone and wedge the at least one slip outward toward the casing, a portion of the inner mandrel moved with the second movement engaging the upper opposing cone and releasing the at least one setting slip.

15. The apparatus of claim 13, wherein the upper opposing cone comprises a first shearable connection to the inner mandrel.

16. The apparatus of claim 15, wherein the lower opposing cone comprises a second shearable connection to the sleeve and is movable between limits relative to the cage.

17. The apparatus of claim 16, wherein the cage and the upper opposing cone have first shoulders engageable with one another, wherein the sleeve and the inner mandrel have second shoulders engageable with one another, wherein the inner mandrel and the upper opposing cone have third shoulders engageable with one another; and/or wherein the sleeve and the cage have fourth shoulders engageable with one another.

18. A tool for setting a packer to support tubing in casing of a borehole, the packer having a housing and a packing element, the tool being retrievable from the set packer and comprising:

an inner mandrel and an outer mandrel for setting the packer and being retrievable therefrom, the outer mandrel having at least one setting slip being movable from a retracted state away from the casing to an extended state toward the casing, the outer mandrel having a first rotatable connection to the inner mandrel and holding the at least one setting slip in the retracted state, the inner mandrel having a second rotatable connection to the housing of the packer, the inner mandrel rotated with first rotation relative to the outer mandrel releasing the first rotatable connection and permitting extension of the at least one setting slip for setting in the extended state in the casing, the inner mandrel moved after the first rotation with first movement relative to the outer mandrel pulling the housing against a portion of the outer mandrel and compressing the packing element in the casing, the inner mandrel rotated with second rotation relative to the outer mandrel releasing the second rotatable connection to the housing.

19. A method of supporting tubing in casing of a borehole, the method comprising:

running the tubing in the casing with a setting tool coupled to a packer on the tubing;

releasing a setting slip of an outer mandrel of the setting tool by rotating an inner mandrel of the setting tool with a first rotation relative to the outer mandrel;

setting the setting slip in the casing by moving the inner mandrel in an initial direction relative to the outer mandrel;

setting a packing element on the packer in the casing by moving the inner mandrel in a first direction relative to the outer mandrel and pulling the packing element against the outer mandrel held in the casing by the set setting slip; and releasing the inner mandrel of the setting tool from the packer by rotating the inner mandrel with a second rotation relative to the outer mandrel to retrieve the setting tool from the set packer.

20. The method of claim 19, wherein the first direction is in an uphole direction, and wherein the initial direction is in either the uphole direction or in a downhole direction.

21. The method of claim 19, wherein the first rotation and the second rotation are in opposite directions or in a same direction.

22. The method of claim 19, wherein releasing the inner mandrel of the setting tool from the packer further comprises releasing the setting slip from the casing by moving the inner mandrel relative to the outer mandrel in a second direction after the second rotation.

23. The method of claim 22, wherein the first and second directions are both in an uphole direction.

24. The method of claim 19, wherein releasing the setting slip of the setting tool by rotating the inner mandrel of the setting tool with the first rotation relative to the outer mandrel comprises unthreading a first rotatable connection of the inner mandrel to the outer mandrel.

25. The method of claim 24, wherein releasing the inner mandrel of the setting tool from the packer comprises unthreading a second rotatable connection of the inner mandrel to the packer.

26. The method of claim 25, wherein rotating the inner mandrel of the setting tool with the first and second rotations comprises clutching the first rotation of the inner mandrel with a swivel relative to the second rotatable connection and transferring the second rotation of the inner mandrel with the swivel to the second rotatable connection.

27. The method of claim 19, wherein setting the packing element on the packer in the casing comprises compressing the packing element against the casing by moving at least one slip, at least one cone, and a compressible element disposed on the packer against one another with the movement against the set outer mandrel.

28. The method of claim 19, further comprising cementing the tubing in the borehole by conducting the cement through the setting tool.

* * * * *